United States Patent [19]

Crook et al.

[11] 4,384,294

[45] May 17, 1983

[54] STABILIZED ANTENNA ARRANGEMENT

[75] Inventors: Richard W. Crook, Coalville; Ian Coghill, Leicester Forest East; David R. James, Tevyford, all of England

[73] Assignee: The Marconi Company Limited, Chelmsford, England

[21] Appl. No.: 259,691

[22] Filed: May 1, 1981

[30] Foreign Application Priority Data

May 3, 1980 [GB] United Kingdom ..... 8014936

[51] Int. Cl.[3] ..... H01Q 1/34; H01Q 3/08

[52] U.S. Cl. ..... 343/709; 343/765

[58] Field of Search ..... 343/709, 710, 765, 766, 343/840

[56] References Cited

U.S. PATENT DOCUMENTS 4,197,548 4/1980 Smith et al. ..... 343/765

FOREIGN PATENT DOCUMENTS 2247829 10/1973 France .
2248623 10/1973 France .
723951 2/1955 United Kingdom .
766344 1/1957 United Kingdom .

*Primary Examiner*—Eli Lieberman
*Attorney, Agent, or Firm*—Spencer & Kaye

[57] ABSTRACT

A stabilized ship borne antenna arrangement is provided with an antenna which is stabilized against pitching and rolling motions of the ship on which it is mounted. The antenna is intended to rotate in azimuth about a stabilized vertical axis and it is mounted on a rotatable member which rotates about an unstabilized axis, which is fixed relative to the ship. Linear actuators link the antenna to the rotatable member with the lengths of the actuators being adjusted so as to maintain the vertical axis of the antenna as it rotates. The stabilized portion of the antenna arrangement is relatively light with a low center of gravity.

10 Claims, 3 Drawing Figures

STABILIZED ANTENNA ARRANGEMENT

Figure 1:
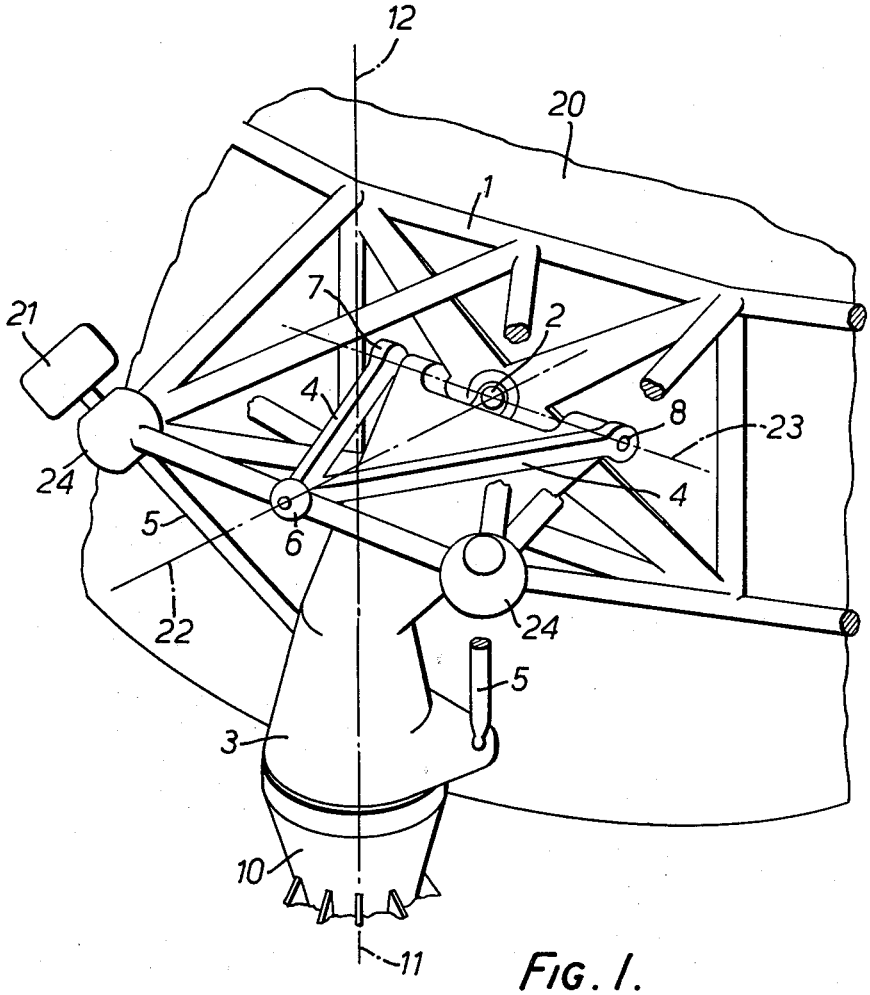

This invention relates to stabilised antenna arrangements and is particularly applicable to antennas which are used aboard ships. It is often very important to ensure that the pointing direction of the antenna is not adversely affected by the pitching and rolling motion of the vessel, since this can seriously reduce the sensitivity of the antenna to weak, directional received signals. The problem is particularly severe with marine surveillance radars, which are required to rotate in azimuth so as to cover the entire field of view surrounding the ship on which it is mounted. Pitching and rolling motion of the ship will cause errors, which will result in the direction of a target identified by the radar being incorrectly indicated.

Various proposals have been put forward for stabilising a ship borne antenna in azimuth, but these can be excessively complex or can result in a very high centre of gravity. For example, it has been proposed to mount an antenna on a stabilised platform with the platform being stabilised against pitch and roll motions, and with the antenna being rotatable in azimuth with respect to the platform.

The present invention seeks to provide an improved stabilised antenna.

According to this invention a stabilised ship borne antenna arrangement includes a rotatable member arranged to rotate about an unstabilised axis which, in use, is fixed relative to the ship; a directional antenna mounted on the rotatable member so as to be rotatable therewith; actuation means coupled between the rotational member and the antenna, or a structure rigidly coupled to the antenna, with the actuation means being operative to stabilise the azimuth axis of the antenna against pitch and roll motions of the ship.

Preferably two actuators are provided and which are positioned so that each is able to turn the antenna about one of two mutually perpendicular elevation axes. Preferably the two actuators are positioned so that when they act in the same sense they cause movement of the antenna about an axis which is perpendicular to that axis about which the antenna is caused to move when the two actuators act in mutually opposite senses. These two axes are subsequently referred to as the main elevation axis and the cross elevation axis.

Preferably again each actuator is constituted by an elongate device whose effective length can be controllably altered.

Conveniently the weight of the antenna (and any structure rigidly coupled to it) is transmitted to the rotational member on which it is mounted by means of a ball joint.

Preferably the antenna is constrained to rotate about the main elevation axis by two pin joints, which are both axially aligned with the centre of rotation of the ball joint.

Preferably again the antenna is arranged to rotate about the cross elevation axis by means of a third pin joint which is aligned with the cross elevation axis which passes through the centre of rotation of the ball joint. Conveniently, the third pin joint is linked to the first two pin joints by means of a rigid linkage.

Figure 2:
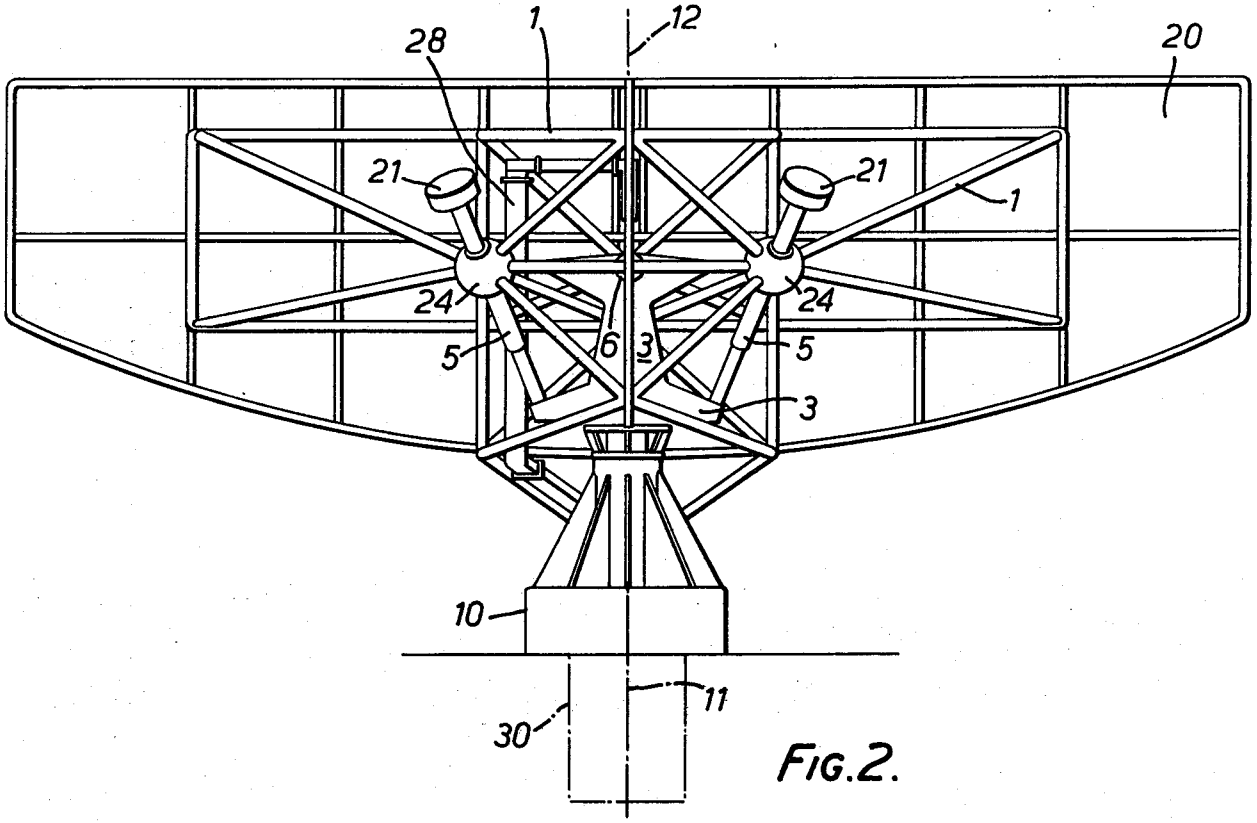
Figure 3:
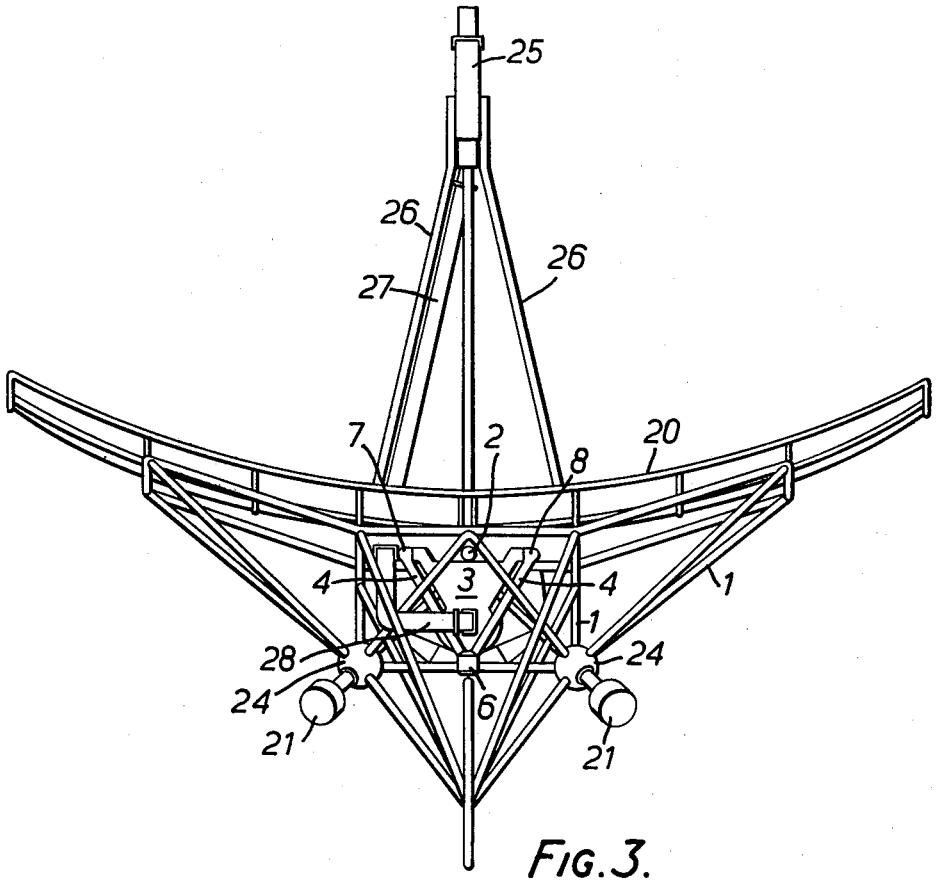

The invention is further described by way of example with reference to the accompanying drawings, which show a stabilised antenna in accordance with the present invention, FIG. 1 showing a part isometric view, and FIGS. 2 and 3 showing elevation and plan views respectively.

Referring to the drawings, an antenna 20 is fixed rigidly to an antenna backing structure 1, which consists of a tubular frame. The tubular frame is arranged so as to maintain the reflecting surface of the antenna rigidly in a predetermined profile, since it is this profile which determines the directional properties of the antenna. The structure 1 is mounted on a rotatable column 3, via a load carrying ball joint 2. The column 3 rotates about an axis relative to a fixed support 10, which in turn is mounted rigidly on a ship. The axis 11 about which the column 3 rotates is termed a training axis. This axis moves with the ship as it pitches and rolls, and is truly vertical only when the ship is perfectly still on placid water, and under this condition, the training axis 11 coincides with the azimuth axis 12. The azimuth axis 12 is the axis about which the antenna is arranged to rotate and is constrained to be vertical by means of actuators 5, which link the column 3 to the structure 1. The actuators 5 consist of elongate members whose effective length can be rapidly and precisely adjusted by controllable adjustors 21 so as to compensate for the pitching and rolling motion of the ship.

The rotational motion of the column 3 is transmitted to the structure 1 via a V-shaped linkage 4, which is provided with three pin joints 6, 7 and 8. Pin joints 7 and 8 lie on the main elevation axis 23 which passes through the centre of rotation of the ball joint 2, whereas the third pin joint 6 is aligned with the cross elevation axis 22. The cross elevation axis 22 also passes through the centre of rotation of the ball joint 2. The main elevation axis 23 and the cross elevation axis 22 are arranged at right angles to each other.

Movement sensors are incorporated in the pin joints 6, 7 and 8 and the signals derived by these sensors are coupled to the adjustors 21, so as to modify the effective lengths of the actuators 5, and thereby compensate for the pitch and roll movements of the ship on which the antenna is mounted. If it is assumed that the longitudinal axis of the ship is parallel with the cross elevation axis 22, then simultaneous operation of the two actuators 5 in the same sense will compensate for pitching motion of the ship, whereas simultaneous operation of the two actuators 5 in a mutually opposite sense will compensate for rolling motion of the ship. As the antenna rotates in azimuth about the vertical axis 12, the actuators 5 are continually adjusted in length so as to compensate for these motions.

Even if the axis 11 remains fixed but off-set from the vertical axis 12, it will be necessary for both actuators 5 to alter their length as the antenna 20 completes each revolution in azimuth. The rate at which the actuators 5 must operate in this case is, of course, determined by the speed of revolution of the antenna 20. In practice this speed of revolution may be low compared to pitching and rolling movements which a ship might experience in rough weather and it is necessary to ensure that the actuators 5 are capable of sufficiently rapid response.

It will be noted, particularly from the plan view shown in FIG. 3 that the actuators 5 are each orientated at 45° relative to the main elevation axis 23 and the cross elevation axis 22. It is because of this orientation that adjustment in the same sense of both actuators compensates for pitching motion of the ship, whereas operation of both actuators in the mutually opposite sense compensates for rolling motion of the ship.

The actuators 5 are each located at a node point 24 of the structure 1. As will be apparent from the drawings, the structure 1 is of a rigid tubular nature, and the node points 24, at which a number of individual tubular members join, provide particularly strong attachment points. Additionally, the node points 24 are spaced apart from the surface of the antenna 20, so as to enable the actuators 5 to obtain considerable leverage. This can be a very important consideration particularly when strong gales are blowing a great deal of force is required in order to controllably orientate the antenna. The column 3, which rotates relative to the fixed support 10, is a relatively robust and rigid structure and the lower ends of the actuators 5 are mounted very closely adjacent to the region at which it is most strongly supported by the upper end of the fixed support 10. However, since the column 3 is not itself stabilised, it is only the relatively light structure 1 composed of tubular members and the thin skinned antenna 20 which are stabilised by the action of the actuators 5. This enables the centre of gravity of the antenna arrangement as a whole to be kept very low and close to the position of the fixed support 10. The relatively light weight of the stabilised portions of the antenna also enable a particularly rapid response to unpredictable rolling and pitching motions of the ship.

FIG. 3 also illustrates the way in which the feed horn 25 is mounted in front of the reflecting surface of the antenna 20 by a rigid but light framework 26. Electromagnetic energy is coupled to the feed horn 25 via a waveguide 27. The waveguide 27 is carried by one of the members of the tubular framework 26 and is coupled to a further waveguide portion 28, which is connected to the top of the column 3. It will be noted that the waveguide 28 enters the column 3 at a point coincident with the axis 11, so that a simple concentric rotating joint 30 enables the waveguide to pass from the column 3 to the fixed support 10.

We claim:

1. A stabilised ship borne antenna arrangement comprising:

a rotatable member arranged to rotate about an unstabilised axis which, in use, is fixed relative to the ship;

a directional antenna mounted on said rotatable member so as to be rotatable therewith;

an azimuth drive linkage arranged to transfer rotational motion from said rotatable member to said antenna, said linkage including at least two pin joints each rotatable about one of two mutually perpendicular axes, one of said at least two pin joints coupling said linkage to said rotatable member, and another of said at least two pin joints coupling said linkage to said antenna;

a multi-axis joint mounting said antenna, the weight of said antenna being substantially wholly transmitted to said rotatable member via said multi-axis joint and said multi-axis joint permitting rotational movement about at least said two mutually perpendicular axes;

two controllable actuators coupled between said rotatable member and said antenna for stabilising the azimuth axis of said antenna against pitch and roll motions of the ship, said actuators being positioned so that when they act in the same sense they cause movement of said antenna about a first predetermined axis, and when said two actuators act in mutually opposite senses they cause movement of said antenna about a second predetermined axis that is perpendicular to said first predetermined axis.

2. An antenna arrangement as claimed in claim 1 and wherein each said actuator is constituted by an elongate device whose effective length can be controllably altered.

3. An antenna arrangement as claimed in claim 1 and wherein said multi-axis joint is provided separately of said pin joints and is constituted by a ball joint.

4. An antenna arrangement as claimed in claim 3 and wherein said ball joint is mounted directly on said rotatable member.

5. An antenna arrangement as claimed in claim 3 and wherein said antenna has a main elevation axis and said antenna is arranged to rotate about said main elevation axis by two of said at least two pin joints which are positioned on opposite sides of said ball joint.

6. An antenna arrangement as claimed in claim 5 and wherein said antenna has a cross elevation axis, said at least two pin joints includes a third pin joint and said antenna is arranged to rotate about said cross elevation axis by means of said third pin joint which is aligned with said cross elevation axis which passes through the center of rotation of said ball joint.

7. An antenna arrangement as claimed in claim 6 and wherein said first and second predetermined axes comprise the two said elevation axes.

8. An antenna arrangement as claimed in claim 7 and wherein said linkage includes a rigid V-shaped linkage having two arms between which said ball joint is located and said third pin joint is linked to said first two pin joints by means of said V-shaped linkage.

9. An antenna arrangement as claimed in claim 1 and wherein said antenna is mounted on a frame having a node point and said actuators each have an end connected to said node point of said frame.

10. An antenna as claimed in claim 9 and wherein said rotatable member has a base and said actuators each have another end connected to said base of said rotatable member.

* * * * *